US005163345A

United States Patent [19]

Doan et al.

[11] Patent Number: 5,163,345

[45] Date of Patent: Nov. 17, 1992

[54] SPRING-LOADED MAGNETIC DRIVER AND METHOD OF ASSEMBLY THEREOF

[75] Inventors: Jimmy T. Doan; Scott W. Predny, both of Kenosha, Wis.

[73] Assignee: Snap-on Tools Corporation, Kenosha, Wis.

[21] Appl. No.: 840,942

[22] Filed: Feb. 25, 1992

[51] Int. Cl.[5] ..... B25B 13/02

[52] U.S. Cl. ..... 81/125; 81/124.1; 76/114

[58] Field of Search ..... 81/125, 124.1; 76/114, 76/119, 101.1

[56] References Cited

U.S. PATENT DOCUMENTS 2,124,844 7/1938 Boroughs .
2,737,974 3/1956 Renick .
2,857,794 10/1958 Red, Jr. .
3,207,010 9/1965 Wendling .
3,392,767 7/1968 Stillwagon, Jr. .
3,937,249 2/1976 Suey .
4,244,246 1/1981 Gillett .
4,787,278 11/1988 Bononi ..... 81/125 X
4,919,020 4/1990 Huebschen .

*Primary Examiner*—D. S. Meislin
*Attorney, Agent, or Firm*—Emrich & Dithmar

[57] ABSTRACT

A tool for rotatably driving a fastening member includes a hollow tubular shank having a socket coupled to one end thereof in communication therewith for receiving an associated rotatable fastener member. A helical compression spring is disposed coaxially within the shank, having the outer end thereof affixed to a magnet disposed for magnetic engagement with the fastening member received in the socket, and having an end coil at the other end thereof disposed outside the other end of the shank with an outer diameter greater than the inner diameter of the shank, the other end of the shank being received in a bore in a handle for cooperation therewith to trap the end coil of the spring, therebetween.

11 Claims, 1 Drawing Sheet

SPRING-LOADED MAGNETIC DRIVER AND METHOD OF ASSEMBLY THEREOF

BACKGROUND OF THE INVENTION

1. Field of the Invention

The present invention relates to tools for rotatably driving threaded fastening members, such as nuts, screws and the like. It has particular application to driving tools having spring-loaded magnetic elements for holding the driven member in engagement with the tool.

2. Description of The Prior Art

Spring-loaded nut drivers are known in the art. U.S. Pat. No. 4,919,020 discloses such a nut driver with a tubular shank having a socket coupled to one end thereof for receiving an associated rotatable fastener. The shank is disposed in a handle bore and has the inner end thereof filled with an epoxy adhesive, which has embedded therein one end of a helical compression spring, the outer end of which carries a magnet disposed for magnetic engagement with the associated fastening member received in the socket. Assembly of this prior nut driver is complicated by the handling of a fluid adhesive material, the accurate positioning of the spring in the fluid material and holding it in position until the adhesive cures.

SUMMARY OF THE INVENTION

It is a general object of the invention to provide an improved driving tool which avoids the disadvantages of prior such tools while affording additional structural and operating advantages.

An important feature of the invention is the provision of a driving tool having a spring-loaded magnet which is of simple and economical construction.

Another feature of the invention is the provision of a tool of the type set forth which does not require a separate step for mounting the spring in place.

In connection with the foregoing feature, another feature of the invention is the provision of a tool of the type set forth, which does not require prolonged positioning of the magnet during an adhesive cure.

These and other features of the invention are attained by providing in a driving tool having a hollow tubular shank with an inner surface and a socket coupled to the shank at one end thereof and communicating therewith for receiving an associated rotatable fastening member, the improvement comprising: a compression spring disposed in the other end of the shank and having an end portion disposed outside the other end of the shank and extending laterally outwardly beyond the inner surface of the shank, magnet means coupled to the spring at the end thereof opposite the end portion, the spring in its normal uncompressed condition projecting into the shank a distance such that the magnet means is disposed for magnetic engagement with an associated fastening member received in the socket, and handle means coupled to the shank at the other end thereof and cooperating therewith to trap the end portion of the spring therebetween to fixedly secure the spring in place.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
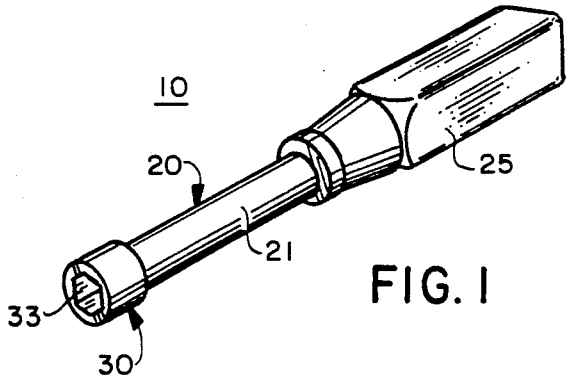
FIG. 1 is a perspective view of a driving tool constructed in accordance with and embodying the features of the present invention.
Figure 2:
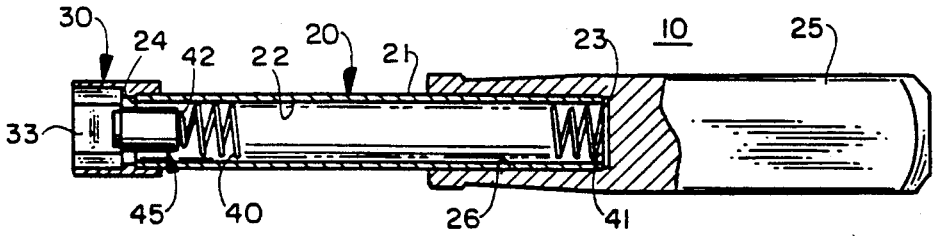
FIG. 2 is an enlarged side elevational view in partial vertical section of the tool of FIG. 1.
Figure 3:
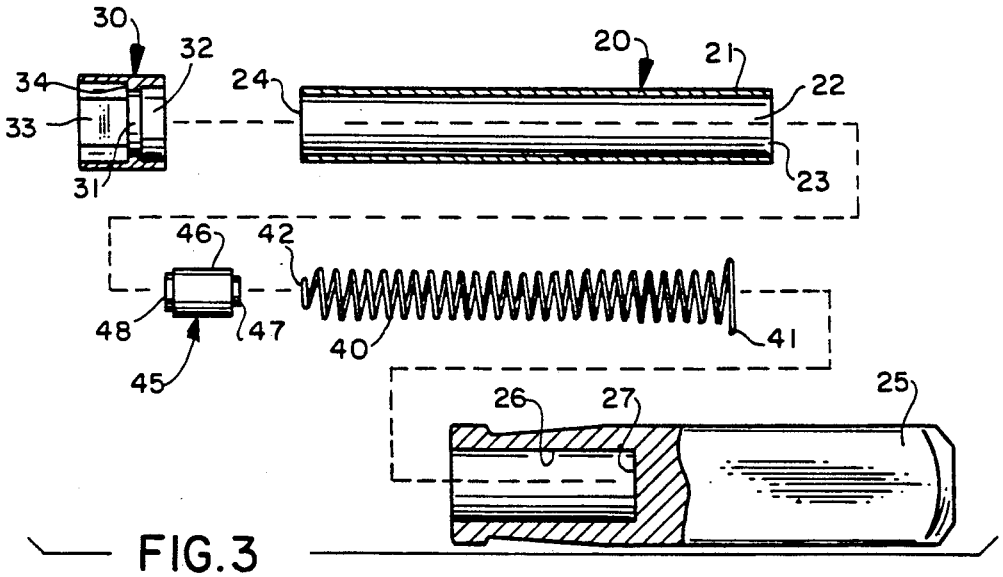
FIG. 3 is an exploded side elevational view in partial vertical section of the tool of FIG. 2.
Figure 4:
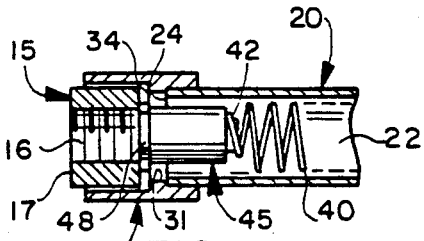
FIG. 4 is a still further enlarged fragmentary view in vertical section of the socket end of the tool of FIG. 2 illustrated with an associated nut received in the socket.
Figure 5:
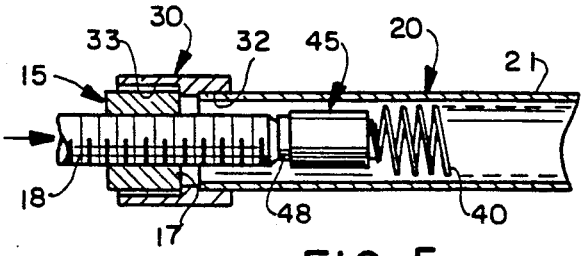
FIG. 5 is a view, similar to FIG. 4, illustrating a bolt shank in threaded engagement with the nut.

Referring to FIGS. 1-3, there is illustrated a driving tool, generally designated by the numeral 10, constructed in accordance with and embodying the features of the present invention. The tool 10 is adapted for manually rotatably driving an associated rotatable threaded fastening member. Referring also to FIGS. 4 and 5, such a fastening member may be a nut 15 having an internally threaded bore 16 extending axially therethrough between opposed parallel end faces 17, and adapted for threaded engagement with the shank of an associated screw or bolt 18. While the tool 10 is illustrated in the drawings in connection with the driving of a nut 15, it will be appreciated that it could also be used for driving a headed fastener.

The tool 10 includes an elongated, hollow, tubular shank 10, which is preferably circularly cylindrical in shape, and has a cylindrical external surface 21 and a cylindrical internal surface 22 and annular end surfaces 23 and 24. The tool 10 also includes an elongated handle 25 having a circularly cylindrical bore 26 formed axially therein at one end thereof and defining a circular end wall 27. In use, the inner end 23 of the shank 20 is adapted to be received into the bore 26 of the handle 25 in a known manner. The shank 20 may be fixed to the handle 25 by suitable means.

Fixedly secured to the outer end of the shank 20 is a socket 30, which is a generally circularly cylindrical member having an axial bore 31 therethrough provided with an enlarged-diameter counterbore portion 32 at the inner end thereof, dimensioned for receiving therein the outer end of the shank 20 and being fixedly secured thereto by any suitable means. The bore 31 of the socket 30 is also provided with an enlarged portion at its outer end defining a receptacle 33 for mateably receiving therein an associated fastening member, such as a nut 15. The enlarged portion defines an annular shoulder 34 at the inner end of the receptacle 33 against which one of the faces 17 of the nut 15 seats in use. While, in the illustrated embodiment, the receptacle 33 is hexagonal in shape for accommodating a hexagonal nut 15, it will be appreciated that the receptacle 33 could be shaped to accommodate any other shape of fastening member.

The driving tool 10 also includes a helical compression spring 40 which, over most of its length, has an outer diameter less than the diameter of the internal surface 22 of the shank 20. The spring 40 is provided at one end thereof with an enlarged-diameter end coil 41 which has an outer diameter greater than the diameter of the internal surface 22 of the shank 20, but preferably no greater than the diameter of the bore 26 in the handle 25. The opposite end of the spring 40 has a reduced-diameter end coil 42 which is coupled to a magnetic assembly 45, which may be of the type disclosed in the aforementioned U.S. Pat. No. 4,919,020. The magnetic assembly 45 includes a cup-like keeper or housing 46 formed of a suitable non-magnetic material, such as brass, and provided at the closed end thereof with a reduced-diameter knob 47 which projects axially therefrom and is adapted to snugly receive the end coil 42 of the spring 40, to fixedly secure the spring 40 to the magnetic assembly 45. A solid cylindrical magnet 48 is press-fitted in the keeper 46 and projects a slight distance outwardly beyond the open end thereof.

Referring now particularly to FIG. 3, the method of assembly of the tool 10 will be described. Initially, the shank 20 is preassembled to the socket 30 in any desired manner, and the spring 40 is preassembled to the magnetic assembly 45. Then the outer end of the spring 40, which carries the magnetic assembly 45, is inserted into the inner end of the shank 20, i.e., the end which defines the end surface 23, until the end coil 41 is stopped against the end surface 23. The length of the spring 40 is such that, when its end coil 41 is engaged with the end surface 23 of the shank 20, with the spring 40 in its normal uncompressed condition, the outer end of the magnet 48 projects a slight distance into the receptacle 33. The inner end of the shank 20 is then inserted into the bore 26 of the handle 25, until the end coil 41 engages the end wall 27 of the bore 26. In this position, illustrated in FIG. 2, it will be appreciated that the end wall 27 cooperates with the end surface 23 of the shank 20 to trap therebetween the end coil 41 of the spring 40, thereby to fixedly hold the spring 40 in place in the shank 20. It will be appreciated that the shank 20 may be fixedly secured in the bore 26 by any suitable means, such as press-fitting, adhesive, set screws or the like.

The outer end of the magnet 48 is preferably dimensioned to bear against the inner face 17 of an associated nut 15 which is seated in the receptacle 33 for magnetically retaining the nut 15 in place in the receptacle 33. It will be appreciated that the keeper 46 serves to magnetically insulate the magnet 48 from the shank 20 so as to ensure unobstructed axial movement of the magnet assembly 45 within the shank 20. In operation, when the nut 15 is driven onto the shank of an associated bolt 18, the tip of the bolt shank engages the magnet 48 and compresses the spring 40 for thereby accommodating the shank of the bolt 18 in the shank 20 of the tool 10. Thus, the nut 15 may be driven for a considerable distance onto the shank of the associated bolt 18.

From the foregoing, it can be seen that there has been provided an improved driving tool and method of assembly thereof, which are characterized by simplicity and economy, and which do not require any special adhesive curing steps or the use of any specialized fixtures for holding the parts in position during adhesive curing.

We claim:

1. In a driving tool having a hollow tubular shank with an inner surface and a socket coupled to the shank at one end thereof and communicating therewith for receiving an associated rotatable fastening member, the improvement comprising: a compression spring disposed in the other end of the shank and having an end portion disposed outside the other end of the shank and extending laterally outwardly beyond the inner surface of the shank, magnet means coupled to said spring at the end thereof opposite said end portion, said spring in its normal uncompressed condition projecting into the shank a distance such that said magnet means is disposed for magnetic engagement with an associated fastening member received in the socket, and handle means coupled to the shank at said other end thereof and cooperating therewith to trap said end portion of said spring therebetween to fixedly secure said spring in place.

2. The tool of claim 1, wherein said spring is a helical spring.

3. The tool of claim 2, wherein said inner surface of said shank has an inner diameter, said end portion of said spring being an end coil of the spring having an outer diameter greater than the inner diameter of the shank.

4. The tool of claim 1, wherein said handle means has a bore therein, said other end of said shank being disposed in said bore.

5. The tool of claim 4, wherein the shank has a rotational axis, said handle being elongated along the rotational axis of the shank.

6. The tool of claim 4, wherein said handle means is fixedly secured to the shank.

7. The tool of claim 1, wherein said magnet means is frictionally gripped by said spring.

8. A method of assembling a driving tool which includes a hollow tubular shank with an inner surface and having a socket coupled to one end thereof in communication therewith for receiving an associated rotatable fastening member, a helical spring having a magnet coupled to one end thereof, and a handle having a bore therein, said method comprising the steps of: providing the spring with an end portion at the other end thereof extending laterally outwardly well beyond the remainder of the spring, inserting the spring into the shank with the end portion of the spring disposed outside the shank and stopped against the other end thereof, and inserting the other end of the shank into the bore of the handle for cooperation therewith to trap the end portion of the spring therebetween.

9. The method of claim 8, wherein the one end of the spring is inserted into the shank from the other end thereof.

10. The method of claim 8, wherein the spring is a helical spring and the end portion is an end coil.

11. The method of claim 8, wherein the shank is fixedly secured in the handle bore.

* * * * *